US007479031B2

(12) United States Patent
Tiberio et al.

(10) Patent No.: US 7,479,031 B2
(45) Date of Patent: Jan. 20, 2009

(54) SNAP TOGETHER ELECTRICAL RECEPTACLE

(75) Inventors: Patrick J. Tiberio, Shelton, CT (US); William A. Valentin, Meriden, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 11/797,085

(22) Filed: Apr. 30, 2007

(65) Prior Publication Data

US 2008/0268679 A1 Oct. 30, 2008

(51) Int. Cl.
*H01R 13/66* (2006.01)

(52) U.S. Cl. ..... 439/538; 439/107; 439/650

(58) Field of Classification Search ..... 439/535, 439/538, 539, 650, 107; 174/53
See application file for complete search history.

(56) References Cited

U.S. PATENT DOCUMENTS 4,059,328 A 11/1977 Rigo
4,379,605 A 4/1983 Hoffman
4,552,421 A 11/1985 Drapkin
5,572,406 A 11/1996 Strang et al.
5,637,000 A 6/1997 Osterbrock et al.
6,015,303 A 1/2000 Bonilla et al.
6,398,594 B1 * 6/2002 Bonilla et al. ..... 439/107
6,767,245 B2 7/2004 King
6,827,602 B2 12/2004 Greene et al.
7,031,126 B2 4/2006 Bonilla et al.
7,164,082 B2 1/2007 Kurek et al.

* cited by examiner

*Primary Examiner*—Tho D Ta
(74) *Attorney, Agent, or Firm*—Jenae C. Gureff; Mark S. Bicks; Alfred N. Goodman

(57) ABSTRACT

A receptacle includes a housing with a face member coupled to a base. A mounting bridge with first and second sides is connected to the base by a bottom member extending along a back surface of the base. The mounting bridge includes at least one substantially L-shaped tab formed on the first side of the bridge engaging a front surface of the base remote from the back surface. An upright post located towards the center of the bridge has a circular opening and a plurality of barbs disposed along its outer edges. Snaps protrude from the first and second ends of the base to engage apertures in the first and second sides of the mounting bridge.

19 Claims, 3 Drawing Sheets

SNAP TOGETHER ELECTRICAL RECEPTACLE

FIELD OF THE INVENTION

The present invention relates to 15 and 20 amp duplex receptacles. More particularly, the present invention relates to a receptacle having a face member with first and second posts engaged with a base. A mounting bridge surrounding the base includes at least one substantially L-shaped tab. The mounting bridge also includes a centrally-located post with barbs along its sides and a circular opening along its upper surface. A snap protruding from ends of the base engages an aperture in the front and rear sides of the mounting bridge to further secure the mounting bridge to the base.

BACKGROUND OF THE INVENTION

Conventional electrical receptacles have two-piece housings formed by separate mateable front and back covers. The covers generally mate together using any known means, such as screws, rivets, or snap-fits. A mounting bridge with ears at opposite ends generally extends between the front and back covers and allows the housing to be attached to a suitable structure, such as a building wall or an electrical box. In some electrical receptacle designs, the mounting bridge has a generally U-shape so as to wrap around portions of the mated front and back covers of the housing and couples to the front and back covers. In other electrical receptacle designs, the mounting bridge is a relatively flat shape and is disposed between the mated front and back covers of the housing. The bridge can be coupled to the housing using any mechanical fasteners, such as screws or rivets.

In many conventional receptacle housings, the two-piece housing is coupled together using fasteners or screws, as described above. This fastener type housing forms a rigidly secured, hard to separate housing, but is cumbersome and difficult to assemble. In many situations, it is necessary to assemble many housings, each having multiple fasteners, creating a time consuming, tedious job.

Additionally, other conventional receptacle housings have a snap-fit design, wherein the front cover snaps to the back cover, holding the bridge in-between. Several designs of snap-fit of housings for electrical receptacles are disclosed in U.S. Pat. No. 4,872,087 to Brant, U.S. Pat. No. 5,510,760 to Marcou et al and U.S. Pat. No. 6,015,303 to Bonilla et al., which are herein incorporated by reference. A design of a snap-fit housing for an accessory strip to an outlet cover plate is disclosed in U.S. Pat. No. 5,613,874 to Orlando et al., which is herein incorporated by reference. While these prior art snap-fit designs allow a quick assembly of the housing without the use of screws or rivets, they do not provide a rigidly coupled housing. In many instances the two housing portions can be twisted or pulled apart relatively easily, thus exposing the electrical receptacle to the outside environment and the installer/user, and possibly causing electrical shock to the installer/user or damage to the electrical receptacle.

Consequently, a need exists for a secure fit housing for an electrical receptacle that is quick and easy to assemble, while simultaneously providing a housing that is difficult or unlikely to be pulled or twisted apart.

SUMMARY OF THE INVENTION

Accordingly, an object of the present invention is to provide a receptacle having a face member with a means for coupling to a base such as posts engaged with pockets of the base.

Another object of the invention is to provide a receptacle with a mounting bridge having two sides surrounding the base and at least one L-shaped tab formed on one of the sides.

A further object of the invention is to provide a receptacle having a mounting bridge with an upright post located towards the center of the bridge having a circular opening.

Still another object of the invention is to provide a receptacle having an upright post covered with barbs on its sides and having a circularly-shaped opening on its top.

Yet another object of the invention is to provide a receptacle having an attachment member or snap feature protruding from ends of the base to engage an aperture in the mounting bridge.

Another object of the invention is to provide a receptacle having a secure fit housing that is quick and easy to assemble.

A further object of the invention is to provide a receptacle with a housing that is difficult or unlikely to be pulled or twisted apart.

The foregoing objects are basically attained by providing a receptacle having a housing with a face member coupled to a base. A mounting bridge with first and second sides is connected to the base by a bottom member extending along a back surface of the base. The mounting bridge includes at least one substantially L-shaped tab formed on the first side of the bridge engaging a front surface of the base remote from the back surface. An upright post located towards the center of the mounting bridge has a circular opening and a plurality of barbs disposed along its outer edges. Snaps protrude from the first and second ends of the base to engage apertures in the first and second sides of the mounting bridge.

By forming the receptacle in this manner, the face member, mounting bridge, and base will be unlikely to be pulled or twisted apart, thus ensuring a secure fit for end users.

As used in this application, the terms "top", "bottom", and "side" are intended to facilitate the description of the receptacle, and are not intended to limit the description of the receptacle to any particular orientation.

Other objects, advantages, and salient features of the present invention will become apparent from the following detailed description, which, taken in conjunction with the annexed drawings, discloses a preferred embodiment of the invention.

BRIEF DESCRIPTION OF THE DRAWINGS

Referring to the drawings which form a part of this disclosure.

DETAILED DESCRIPTION OF THE INVENTION

Figure 1:
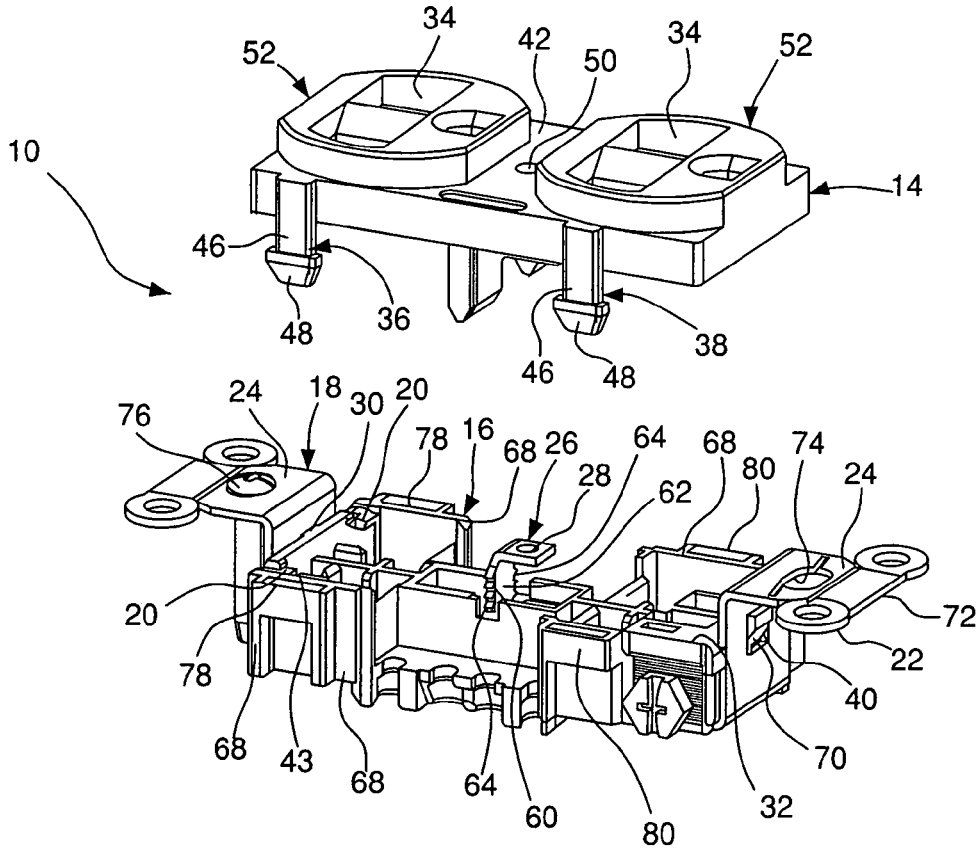
FIG. 1 is an exploded side perspective view of a receptacle according to an embodiment of the present invention.
Figure 2:
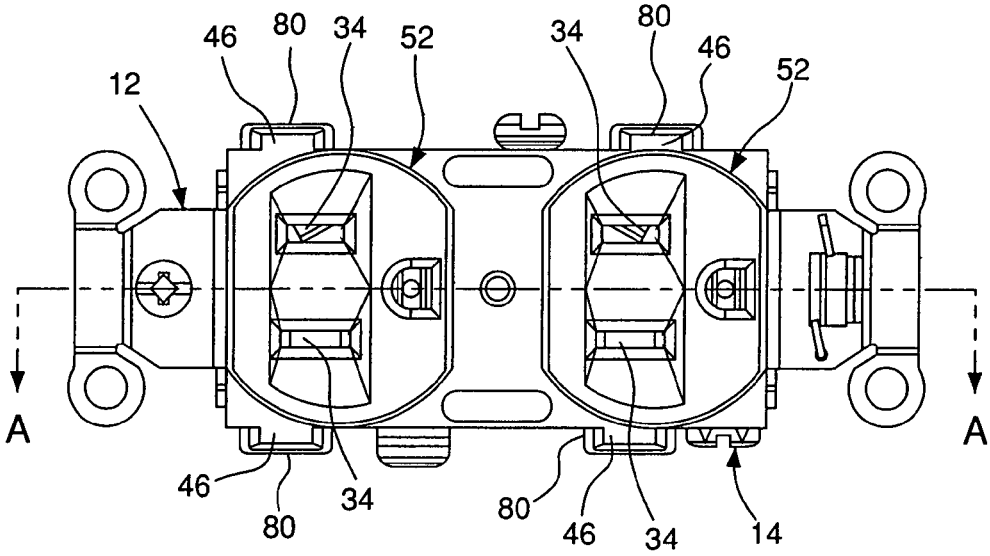
FIG. 2 is a top elevational view of the receptacle of FIG. 1 with the face member and base attached with a locking means.
Figure 3:
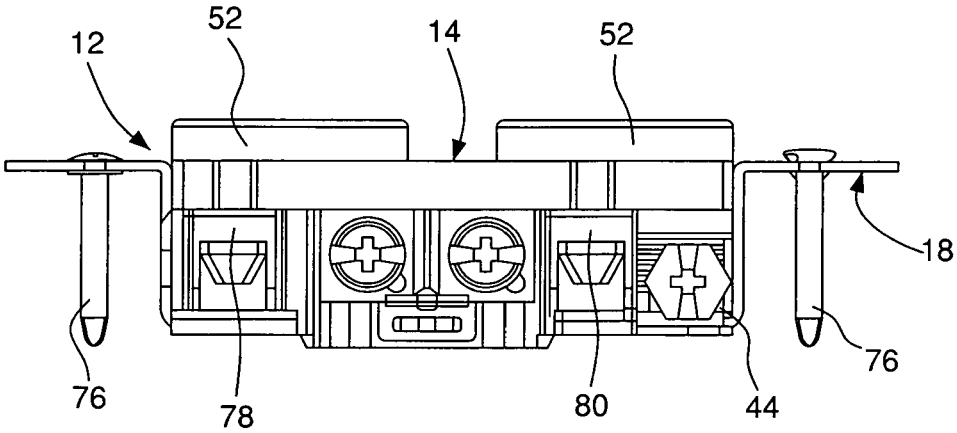
FIG. 3 is a side elevational view of the receptacle of FIG. 1 with the face member and base attached.

As seen in FIG. 1, the receptacle 10 includes a housing 12 having a face member 14 coupled to a base 16. The housing 12 also includes a mounting bridge 18 with first and second sides 22, 24 connected by a bottom member 58 extending along a back surface 44 of the base 16. The mounting bridge 18 includes at least one substantially L-shaped tab 20 formed on the first side 22 engaging a front surface 43 of the base 16 remote from the back surface 44. The housing 12 further includes a post 26 located towards the center of the mounting bridge 18 with a circular opening 28. An attachment member or snap feature 40 protrudes from first and second ends 30, 32 of the base 16.

The face member 14 is a standard duplex type having surface openings 34 therethrough for receiving two electrical plugs or outlets. However, the face member 14 can have any number of openings for any type of electrical device. The face member 14 can be a variety of styles including, but not limited to, flat, finder groove, style-line, tamper resistant, leaded, back wired, side wired, and hospital grade. In addition, the face member 14 includes a means for coupling to the base 16. The face member 14 can be coupled to the base with first and second posts 36, 38 protruding from the upper surface 42 of the face member 14 and engaging base pockets 78, 80. Each post 36, 38 has a body portion 46 extending outwardly and downwardly from the upper surface 42 and terminating in a tapered protrusion 48 at the distal end thereof. Each protrusion 48 is substantially triangularly-shaped with a tapered end for sliding one way into an opening without the ability to easily reverse from the opening. The protrusions 48 fix the face member 14 and base 16 together.

The upper surface 42 also includes a circularly-shaped aperture 50 spaced between the surface openings 34 of the duplex outlets 52. The aperture 50 is adapted to receive a screw or similar attachment mechanism that can be engaged through aperture 50 to couple a face member.

The mounting bridge 18 is preferably made of steel or a material of similar strength and flexibility. The first and second sides 22, 24 of the mounting bridge 18 surround the base 16. The mounting bridge 18 is substantially U-shaped with a flat bottom member or surface 58 having an opening 66. A center post 26 projecting upright from the bottom surface 58 of the mounting bridge 18 is formed with the material from the bottom surface 58 adjacent to the opening 66.

Figure 5:
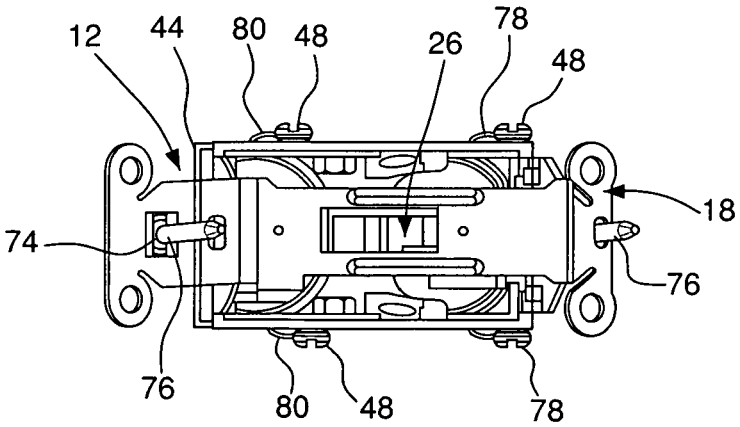
FIG. 5 is a bottom plan view of the receptacle of FIG. 1 with the face member and base attached via the locking means.
Figure 6:
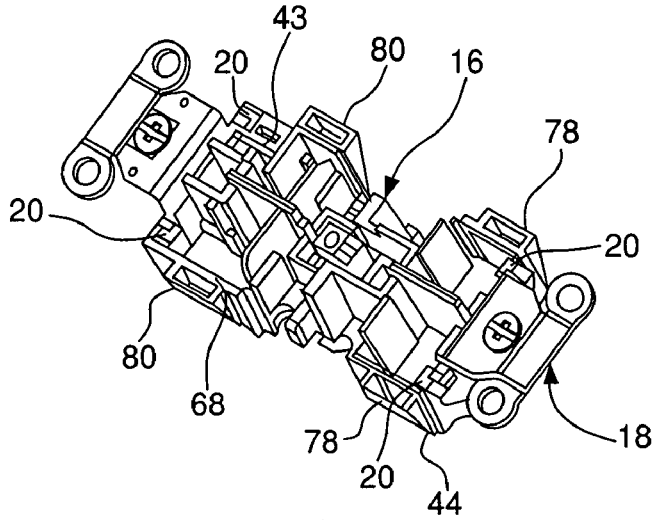
FIG. 6 is a top perspective view of the receptacle of FIG. 1 without the face member and with the locking means of FIGS. 3-5.
Figure 7:
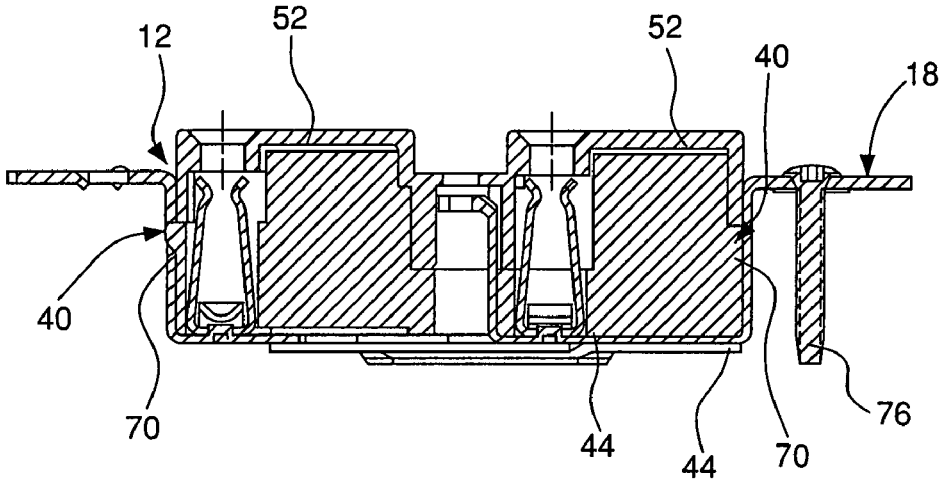
FIG. 7 is a side elevational view in cross section of the receptacle taken along line A-A of FIG. 2.
Figure 8:
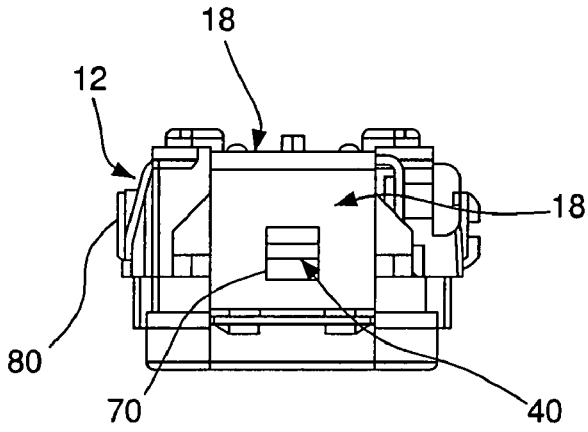
FIG. 8 is a side elevational view of the receptacle of FIG. 1 at the end of the attachment members.

The center post 26 is substantially L-shaped with first and second edges 60, 62 perpendicular to the bottom 58 of the mounting bridge 18 as shown in FIG. 5. First and second edges 60, 62 are defined by a plurality of barbs 64. Atop the post 26 is the circularly-shaped aperture 28 adapted for receiving a screw or similar attachment mechanism. The face member 14 is mounted after the base 16 is installed with the mounting bridge 18. The barbs 64 are ribbed and sharp enough to engage an object, i.e., the face member 14, placed over the mounting bridge 18 if and when such an assembly is sandwiched together.

Figure 4:
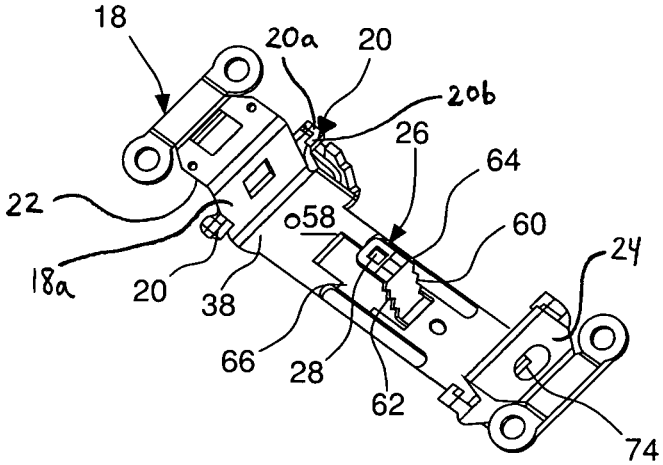
FIG. 4 is a top perspective view of the mounting bridge of FIG. 1.

The mounting bridge 18 further includes at least one substantially L-shaped tab 20 formed on a first side portion 18*a* engaging a front surface 43 of the base 16 remote from the back surface 44. Preferably, each side 22, 24 includes at least one L-shaped tab 20 closest to the first end 30 and second end 32 of the base 16. The L-shaped tabs 20 are angled at substantially 90° from the base wall 68. Each tab 20 includes a first part 20*a* extending a right angle from the first side portion 18*a* of first side 22 and a second part 22*b* extending at a right angle from the first part, as seen in FIG. 4. Prior to assembly, the tabs 20 are formed perpendicular to the longitudinal axis A of the mounting bridge 18. Upon assembly, the tabs 20 are pivoted 90° towards the bottom surface 58 and interior of the housing 12. The tabs 20 lock behind the wall 68 of the base 16 to prevent the mounting bridge 18 from separating from the rest of the device 10. The tabs 20 are adapted to lock a member between the tabs 20 and the mounting bridge 18.

The mounting bridge 18 further includes an aperture 70 in each of the first and second sides 22, 24 disposed along the longitudinal axis. The apertures 70 are substantially rectangularly-shaped and also positioned between the L-shaped tabs 20. The apertures 70 are adapted to receive another locking means for connecting a member to the mounting bridge 18. Outwardly facing ends 72 of the mounting bridge 18 are formed at substantially 90° angles and are inverted L-shapes with respect to the longitudinal axis A. Each of the outwardly facing ends 72 includes an aperture 74 for receiving a fastening means such as a screw 76. The aperture is adjacent to the outer edge of the mounting bridge 18. The fastening means 76 mounts the receptacle 10 to a wall box or similar stable structure.

The base 16 of the housing 12 includes a front surface 43, a back surface 44, along with additional conventional electrical structures as is known to one skilled in this art. Further, the base 16 includes first and second pairs of pockets 72, 74 located on the outermost wall 68 of the base 16. First pair of pockets 78 are adjacent to the first end 30 of the base 16. Second pair of pockets 80 are adjacent to the second end 32 of the base 16.

An additional locking feature of the receptacle 10 is the snap or attachment members 40. The attachment members 40 are tabs or snaps projecting from the outer edges of the base 16, one located at the first end 30 and one at the second end 32. When the mounting bridge 18 and base 16 are connected, the snap members 40 engage apertures 70 of the mounting bridge 18. One aperture 70 is located at the first end 82 of the mounting bridge 18 while another aperture 70 is located at the second end 84. This secure fit prevents the mounting bridge 18 from detaching from the base 16.

While a particular embodiment has been chosen to illustrate the invention, it will be understood by those skilled in the art that various changes and modifications can be made therein without departing from the scope of the invention as defined in the appended claims.

What is claimed is:

1. An electrical receptacle comprising:

a housing having a face member coupled to a base; and a mounting bridge having first and second sides connected by a bottom member extending along a back surface of said base, said mounting bridge including at least one substantially L-shaped tab formed on said first side engaging a front surface of said base remote from said back surface, said L-shaped tab having a first part extending parallel to said bottom member and at a right angle from said first side and a second part extending parallel to said bottom member and at a right angle from the first part.

2. An electrical receptacle according to claim 1 wherein first and second posts extend from said face member and engage first and second pockets of said base.

3. An electrical receptacle according to claim 1 wherein said mounting bridge includes an upright post located at a center of said bridge having a circular opening.

4. An electrical receptacle according to claim 3 wherein said mounting bridge includes a plurality of barbs disposed on first and second edges of said post.

5. An electrical receptacle according to claim 1 wherein said housing includes attachment members protruding from first and second ends of said base.

6. An electrical receptacle according to claim 5 wherein said attachment members are snaps protruding from first and second ends of said base and engaging apertures in said first and second sides of said mounting bridge.

7. An electrical receptacle comprising:

a housing having a face member coupled to a base, a mounting bridge having first and second sides connected by a bottom member extending along a back surface of said base, said mounting bridge including an upright post located towards a center of said bridge having a circular opening; and an L-shaped tab formed on said mounting bridge having a first part extending parallel to said bottom member and at a right angle from said first side and a second part extending parallel to said bottom member and at a right angle from the first part.

8. An electrical receptacle according to claim 7 wherein said mounting bridge includes a plurality of barbs disposed on first and second edges of said post.

9. An electrical receptacle according to claim 7 wherein said housing includes attachment members protruding from said first and second ends of said base.

10. An electrical receptacle according to claim 9 wherein said attachment members are snaps protruding from first and second ends of said base and engaging apertures in said first and second sides of said mounting bridge.

11. An electrical receptacle according to claim 7 wherein first and second posts extend from said face member and engage first and second pockets of said base.

12. An electrical receptacle comprising:

a housing having a face member coupled to a base, an attachment member protruding from first and second ends of said base; and an L-shaped tab formed on a mounting bridge with first and second sides connected by a bottom member extending along a back surface of said base, said L-shaped tab having a first part extending parallel to said bottom member and at a right angle from said first side and a second part extending parallel to said bottom member and at a right angle from the first part.

13. An electrical receptacle according to claim 12 wherein said attachment members are snaps protruding from first and second ends of said base and engaging apertures in said first and second sides of said mounting bridge.

14. An electrical receptacle according to claim 12 wherein first and second posts extend from said face member and engage first and second pockets of said base.

15. An electrical receptacle comprising:

a housing having a face member coupled to a base;

a mounting bridge having first and second sides connected by a bottom member extending along a back surface of said base, said mounting bridge including at least one substantially L-shaped tab formed on said first side engaging a front surface of said base remote from said back surface, said L-shaped tab having a first part extending parallel to said bottom member and at a right angle from said first side and a second part extending parallel to said bottom member and at a right angle from the first part;

an upright post located towards the center of said bridge having a circular opening; and an attachment member protruding from first and second ends of said base.

16. An electrical receptacle according to claim 15 wherein first and second posts extend from said face member and engage first and second pockets of said base.

17. An electrical receptacle according to claim 15 wherein said mounting bridge includes a plurality of barbs disposed on first and second edges of said post.

18. An electrical receptacle according to claim 15 wherein said attachment members are snaps protruding from first and second ends of said base and engaging apertures in said first and second sides of said mounting bridge.

19. An electrical receptacle comprising:

a housing having a face member with first and second posts coupled to first and second pockets of a base;

a mounting bridge having first and second sides connected by a bottom member extending along a back surface of said base, said mounting bridge including at least one substantially L-shaped tab formed on said first side engaging a front surface of said base remote from said back surface, said L-shaped tab having a first part extending parallel to said bottom member and at a right angle from said first side and a second part extending parallel to said bottom member and at a right angle from the first part;

an upright post located at a center of said bridge having a circular opening and a plurality of barbs disposed on first and second edges of said post; and at least two snaps protruding from first and second ends of said base and engaging apertures in said first and second sides of said mounting bridge.

* * * * *